United States Patent [19]

Furuya

[11] 4,356,829

[45] Nov. 2, 1982

[54] ANTI-JAMMING MEANS FOR COIN COUNTING MACHINES

[75] Inventor: Katusuke Furuya, Tokyo, Japan

[73] Assignee: Laurel Bank Machine Co., Ltd., Tokyo, Japan

[21] Appl. No.: 862,839

[22] Filed: Dec. 21, 1977

[30] Foreign Application Priority Data

Dec. 29, 1976 [JP] Japan ..... 51-158390

[51] Int. Cl.[3] ..... G07D 9/00

[52] U.S. Cl. ..... 133/8 R; 221/21

[58] Field of Search ..... 133/1 R, 4 R, 8 R, 8 A, 133/8 E, 2; 221/21

[56] References Cited

U.S. PATENT DOCUMENTS 2,881,975 4/1959 Bower ..... 133/8 R X
3,409,116 11/1968 O'Malley ..... 221/21
3,754,558 8/1973 Conant et al. ..... 133/8 R X
3,948,279 4/1976 Gupta ..... 133/1 R
4,041,280 8/1977 Ohsako et al. ..... 133/8 R X

*Primary Examiner*—Joseph J. Rolla
*Attorney, Agent, or Firm*—Stevens, Davis, Miller & Mosher

[57] ABSTRACT

A coin counting machine is described having an anti-jamming device for removing jammed coins from a passageway. A jam detection circuit is provided for indicating the jamming of a passageway. A stop control circuit is provided whereby the coin counting machine operation is halted at which time the jam is removed. Jam removal is accomplished by reversing direction of operation of the counting machine. The apparatus described thereby prevents damage to the machine which would normally result from coin jamming.

5 Claims, 2 Drawing Figures

ANTI-JAMMING MEANS FOR COIN COUNTING MACHINES

Figure 1:
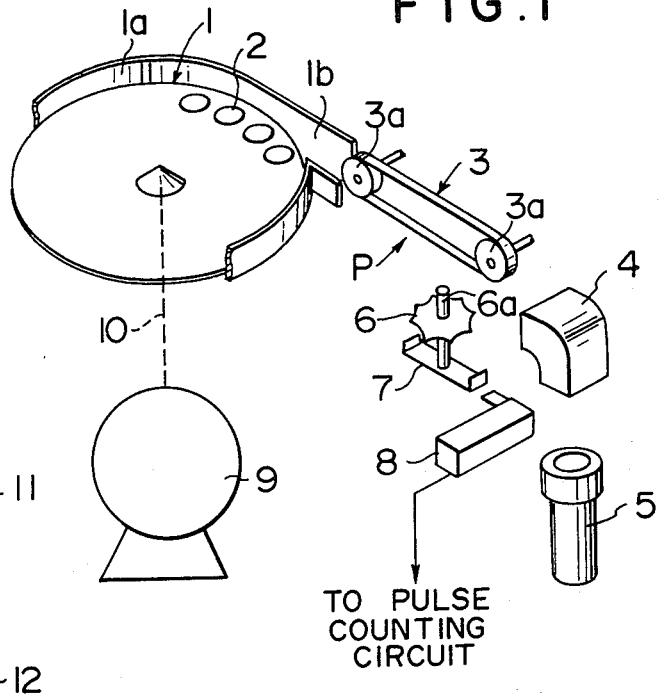

The present invention relates to coin counting machines and more particularly to anti-jamming means for coin counting machines.

In conventional coin counting machines, there is provided a coin feeding device which includes a rotatable disc and at least one outlet adapted to pass coins one after another in series from the rotatable disc. The outlet is contiguous with a coin passage having a coin feeding member such as a belt or wheel and provided with means for counting coins passing therethrough. Such coin counting machines may be used by themselves for simply counting coins or constituted as a part of coin packaging machines or of coin sorting machines. In operation of such coin counting machines, coins are put on the rotatable disc which is then driven by a suitable motor whereby the coins are forced to pass one-by-one through the outlet. In such conventional mechines, problems have often been experienced since coins have often been jammed in the coin passage and time has been consumed in removing jammed coins. Since conventional machines are so designed that machine operations are continued even when jamming have occurred, the coin feeding belts or wheels have often been damaged by such jammed coins.

The present invention has therefore an object to provide coin counting machines having means for substantially eliminating jamming of coins.

Another object of the present invention is to provide means for preventing coin feeding members of coin counting machines from being damaged due to continued machine operation under coin jamming.

Still further object of the present invention is to provide means for automatically relieving coin jammings in coin counting machines.

According to the present invention, the above and other objects can be accomplished by coin counting machines comprising a rotatable disc disposed in a peripheral wall having an outlet, a motor for driving said disc, a coin passageway provided contiguous with said outlet in the peripheral wall and including coin feeding member for driving coins along the passageway, means for driving the coin feeding member means, for counting the number of coins which have passed through the passageway, means for sensing coin jamming, and means for operating the motor means and the drive means in one direction under normal operation and reversing the direction of operation of at least the drive means when coin jamming has been sensed. It is of course preferable to have the direction of operation of both the motor means and the drive means reversed. The coin jamming sensing means may receive a counting signals from the counting means and produce a jam signal when a succeeding counting signal has not been received within a predetermined time after a preceding signal has been received.

In accordance with a further aspect of the present invention, the reverse operation is continued for a predetermined time and thereafter the machine is automatically returned to its normal operation. Means may be provided for automatically stopping the machine when jamming cannot be relieved even after a predetermined number of repeated reverse operations.

Figure 2:
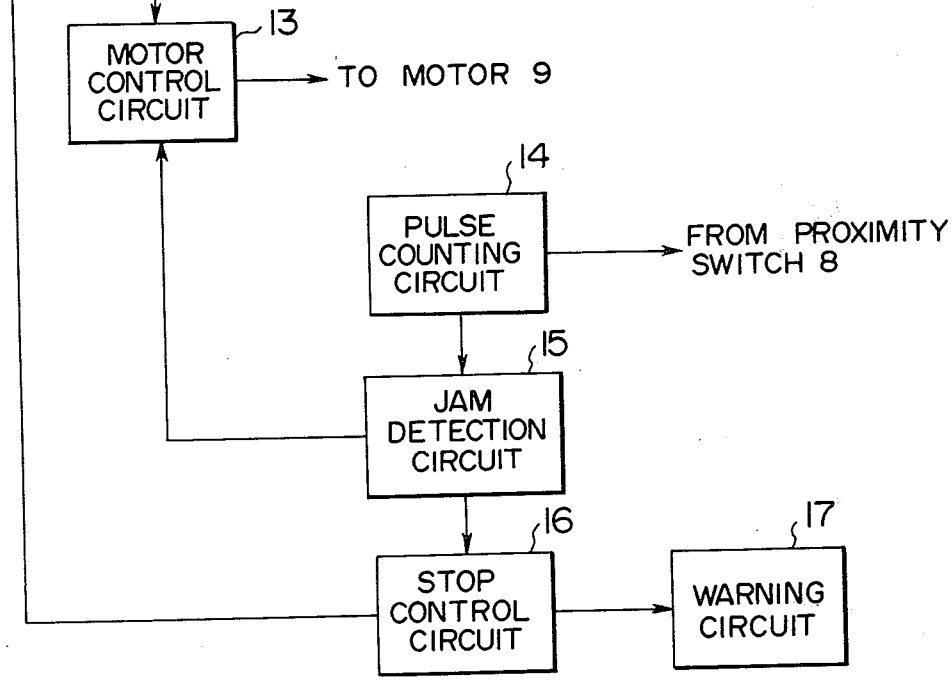

The above and other objects and features of the present invention will become apparent from the following descriptions of a preferred embodiment taking reference to the accompanying drawings in which:

FIG. 1 is a diagrammatical perspective view of a coin counting machine embodying the feature of the present invention; and FIG. 2 is a block diagram showing the control circuit in accordance with one embodiment of the present invention.

Referring to the drawings, particularly to FIG. 1, the coin counting machine shown therein includes a rotatable disc 1 surrounded by a peripheral wall 1*a* which has an outlet 1*b*. The disc 1 is adapted to receive thereon a number of coins 2 as shown in FIG. 1. Contiguous with the outlet 1*b*, there is formed a coin passage P which is provided with a coin feed belt 3. The coin feed belt 3 is passed around a pair of spaced pulleys 3*a*, one of which is a power driven pulley. The coin passage P is contiguous with a chute 4 through which coins are passed one after another into a coin stacking cylinder 5.

At one side of the coin passage P, there is provided a coin counting wheel 6 which may be of conventional configuration and connected through a shaft 6*a* with a detecting piece 7 of magnetic material. The wheel 6 is so arranged with respect to the coin passage P that when a coin 2 passes through the passage P the wheel 6 is rotated for a predetermined angle, for example, 180°. A proximity switch 8 is provided adjacent to the detecting piece 7 so that the piece 7 is rotated with the wheel 6 along a path adjacent to the proximity switch 8 at each time when a coin 2 passes through the coin passage P to actuate the switch 8. A reversible motor 9 is provided for driving the disc 1 through a shaft 10. The coin feeding belt 3 may also be driven by the same motor 9.

Thus, in normal operation, the disc 1 and the coin feeding belt 3 is driven in the normal direction and coins 2 on the disc 1 are forced to pass one after another through the outlet 1*b* of the peripheral wall 1*a* to the coin passage P. The coins 2 are then fed through the chute 4 into the stacking cylinder 5. The number of coins 2 which have passed through the passage P is counted by the counting mechanism including the counting wheel 6, the detecting piece 7 and the proximity switch 8, and electric pulses are produced in number corresponding to the number of coins 2 which has passed through the passage P.

Referring now to FIG. 2, the control circuit shown therein includes a start switch 11 which is connected with a count start circuit 12 which is in turn connected with a motor control circuit 13 for controlling the operation of the reversible motor 9.

The proximity switch 8 is connected with a pulse counting circuit 14 so that the number of pulses from the switch 8 is counted by the circuit 14. The output of the pulse counting circuit 14 is connected with a jam detecting circuit 15 which has an output connected with the motor control circuit 13. The jam detection circuit 15 is also connected with a stop control circuit 16 which is in turn connected with the count start circuit 12 as well as with a warning circuit 17.

The pulse counting circuit 14 receives the signal pulses from the proximity switch 8 and produces an output representing the number of input pulses. The jam detecting circuit 15 functions to interpret the signal from the pulse counting circuit 14 and produces a reverse operation signal when the count signal from the pulse counting circuit 14 has not increased within a predetermined time, for example 3 seconds. Thus, when coin jamming has occurred and remained for more than the predetermined time, it is detected by the jam detecting circuit 15.

The reverse operation signal is transmitted to the motor control circuit 13 which then functions to operate the motor in the direction opposite to the direction of normal operation. Thus, the rotatable disc 1 and the coin feeding belt 3 are driven in the reverse direction so that the jammed coin is forced in the reverse direction. After a second predetermined time for example 5 seconds of reverse operation, the motor control circuit 13 functions to return the motor 9 to the normal operation.

When the coin jamming has not been relieved through the predetermined time of reverse operation, the jam detecting circuit 15 again produces a reverse operation signal after the first mentioned predetermined time, for example 3 seconds so that the motor 9 is operated in the reverse direction. Then, the motor operation is returned to the normal direction after the second predetermined time, for example 5 seconds. The reverse operation may thus be repeated until the coin jamming is releived.

The reverse operation signal from the jam detecting circuit 15 is also transmitted to the stop control circuit 16 which functions to count the number of reverse operation signals. When a predetermined number, for example three, of reverse operation signals are successively produced, the stop control circuit 16 produces a stop signal which is transmitted to the count start circuit 12 whereby the motor operation is stopped through the motor control circuit 13. At the same time, the output from the stop control circuit 16 is transmitted to the warning circuit 17 so as to energize a suitable warning device such as a buzzer or a bell. Then, the jammed coin may be manually removed and the motor operation is started by actuating the start switch 11.

The invention has thus been shown and described with reference to a specific embodiment, however, it should be noted that the invention is in no way limited to the details of the illustrated structures but changes and modifications may be made without departing from the scope of the appended claims.

I claim:

1. Coin counting machine comprising a rotatable disc disposed in a peripheral wall having an outlet, a motor for driving said disc, a coin passageway provided contiguous with said outlet in the peripheral wall and including a coin feeding member for driving coins along the passageway, means for driving the coin feeding member, means for counting the number of coins which have passed through the passageway, means for sensing coin jamming, and means for operating the motor and the means for driving in one direction under normal operation and reversing the direction of operation of at least the drive means when coin jamming has been sensed.

2. Coin counting machine in accordance with claim 1 in which both of the motor and the means for driving are operated in the reverse direction when the coin jamming has been sensed.

3. Coin counting machine in accordance with claim 1 in which said means for sensing coin jamming includes means for receiving a counting signal from said means for counting for producing a jam signal when a succeeding counting signal has not been received within a predetermined time after a preceding signal has been received.

4. Coin counting machine in accordance with claim 1 in which means is provided for automatically returning the machine into the normal operation after the reverse operation has been continued for a predetermined time.

5. Coin counting machine in accordance with claim 4 in which means is provided for stopping the machine when a predetermined number of reverse operations have successively occurred.

* * * * *